US008621890B2

(12) United States Patent
Veillet

(10) Patent No.: US 8,621,890 B2
(45) Date of Patent: Jan. 7, 2014

(54) KNITTED CUT-RESISTANT GLOVE, WITHOUT FIBREGLASS

(75) Inventor: Florent Veillet, Crissey (FR)

(73) Assignee: Honeywell International Inc., Morristown, NJ (US)

( * ) Notice: Subject to any disclaimer, the term of this patent is extended or adjusted under 35 U.S.C. 154(b) by 9 days.

(21) Appl. No.: 13/328,517

(22) Filed: Dec. 16, 2011

(65) Prior Publication Data

US 2012/0233740 A1 Sep. 20, 2012

(30) Foreign Application Priority Data

Dec. 22, 2010 (EP) ..... 10196491

(51) Int. Cl.
*D04B 7/34* (2006.01)

(52) U.S. Cl.
USPC ..... 66/174

(58) Field of Classification Search
USPC ..... 66/170, 171, 174; 2/159–164
See application file for complete search history.

(56) References Cited

U.S. PATENT DOCUMENTS

| | | | | | |
|---|---|---|---|---|---|
| 4,384,449 | A * | 5/1983 | Byrnes et al. | 57/210 |
| 4,470,251 | A * | 9/1984 | Bettcher | 57/230 |
| 4,912,781 | A * | 4/1990 | Robins et al. | 2/2.5 |
| 5,248,548 | A * | 9/1993 | Toon | 428/222 |
| 5,644,907 | A * | 7/1997 | Kolmes et al. | 57/230 |
| 5,853,885 | A * | 12/1998 | Prickett | 428/401 |
| 5,965,223 | A * | 10/1999 | Andrews et al. | 428/34.5 |
| 6,016,648 | A * | 1/2000 | Bettcher et al. | 57/230 |
| 6,103,371 | A * | 8/2000 | Prickett | 428/359 |
| 6,132,871 | A * | 10/2000 | Andrews | 428/377 |
| 6,161,400 | A * | 12/2000 | Hummel | 66/174 |
| 6,266,951 | B1 * | 7/2001 | Chakravarti | 57/210 |
| 6,279,305 | B1 * | 8/2001 | Hummel | 57/210 |
| 6,826,898 | B1 * | 12/2004 | Hummel | 57/210 |
| 6,874,336 | B2 * | 4/2005 | Yarborough et al. | 66/174 |
| 7,127,879 | B2 * | 10/2006 | Zhu et al. | 57/236 |
| 7,762,053 | B2 * | 7/2010 | Takada | 57/230 |
| 7,934,394 | B2 * | 5/2011 | Zhu | 66/174 |
| 2004/0261465 | A1 * | 12/2004 | Yarborough et al. | 66/169 R |
| 2005/0091961 | A1 * | 5/2005 | Prickett | 57/238 |

FOREIGN PATENT DOCUMENTS

| | | | |
|---|---|---|---|
| EP | 1160363 | A1 * | 12/2001 |
| EP | 1678356 | B1 * | 1/2008 |
| FR | 2920787 | A1 * | 3/2009 |
| WO | WO 2010026387 | A2 * | 3/2010 |

* cited by examiner

*Primary Examiner* — Danny Worrell
(74) *Attorney, Agent, or Firm* — Wood, Phillips, Katz, Clark & Mortimer

(57) ABSTRACT

This glove (10) is knitted using three yarns, that is, a first composite yarn prepared by wrapping one or more highly abrasion-resistant polyamide yarns on a composite core made by direct cabling of a stainless steel yarn and one or more highly abrasion-resistant polyamide yarns, a second polyamide elastane yarn, and a third para-aramid yarn, the double-sided knitting being carried out by plating so that the first and second yarns are located on a first side of the knit while the para-aramid yarn is located on the second side of the knit.

19 Claims, 1 Drawing Sheet

Fig.1
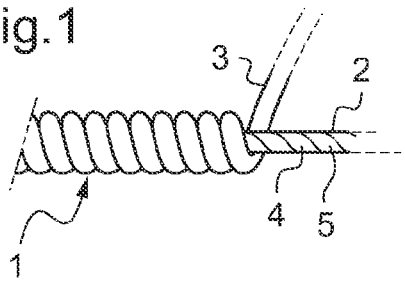
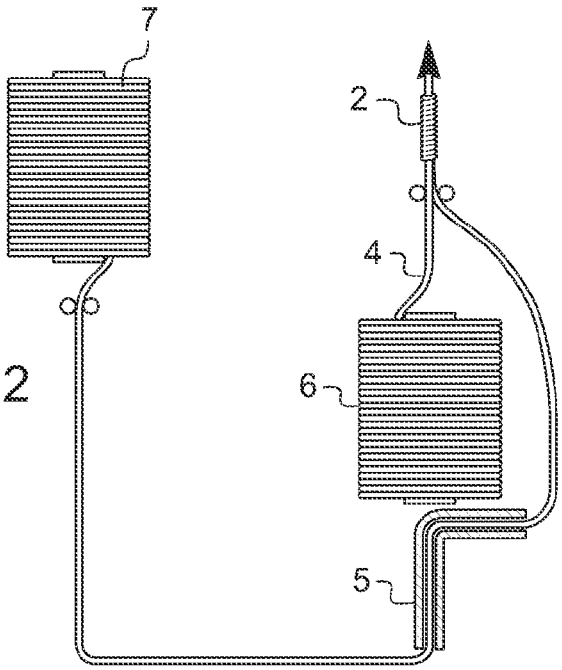
Fig.2
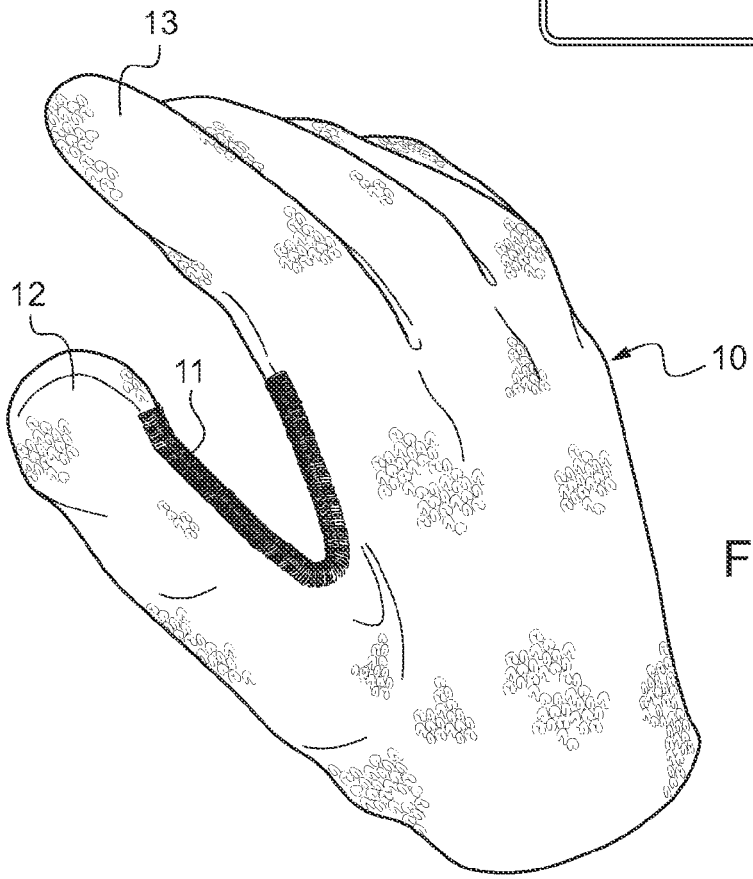
Fig.3

KNITTED CUT-RESISTANT GLOVE, WITHOUT FIBREGLASS

CROSS-REFERENCE TO RELATED APPLICATIONS

This application claims priority to European Patent EP 2 468 121 B1, filed Dec. 12, 2010.

FIELD

The present invention relates to a professional cut-resistant knitted glove.

BACKGROUND

Cut-resistant gloves used today are generally seamless knitted gloves, with or without coating (polyurethane, latex, nitrile, PVC or the like).

Most gloves offering high cut resistance contain fibreglass. For example, document EP 1160363 describes gloves knitted in a cut-resistant composite yarn comprising a fibreglass core around which at least one metal strand and at least one non-metallic covering strand is wound.

In Europe, these gloves are subject to standard EN388 which serves to test the resistance to cutting and also to abrasion, tearing and perforation. However, the cutting test of this standard is controversial because it does not represent a real risk of cutting and enables fibres like fibreglass to obtain very good performance (level 5/5), whereas fibreglass does not really provide protection against cutting and is also highly allergenic. In the context of the cutting test of standard EN388, the fibreglass therefore owes its very good performance to the fact that it blunts the blade which tests the sample.

Furthermore, other cutting tests are available, better representing a real cut, and highlighting fibres offering real cut resistance. This is the case of the test of standard ISO 13997, which is a very good complement to the test of standard EN388.

Fibreglass-free gloves are already known. Thus document U.S. Pat. No. 6,874,336 describes a cut-resistant glove, which keeps the warmth but preventing or at least absorbing the perspiration, prepared by knitting with a technical side knitted with metal core fibres surrounded by cut-resistant fibre, in particular aramid, and an opposite side of hydrophilic fibres, for example polyester, which extend up to the first technical side. Document U.S. Pat. No. 6,534,175 also describes a cut-resistant glove knitted with metal core yarns and a para-aramid fibre winding. Although these gloves represent an improvement over the two gloves which were customarily worn one over the other previously to obtain the same thermal results, they are still open to improvement, in particular in terms of flexibility.

SUMMARY

It is the object of the invention to develop a cut-resistant glove, without fibreglass, knitted without seams and useable uncoated, and obtaining very good performance in the cut-resistance tests, whether according to standard EN388 or according to standard ISO 13997, while being comfortable and offering dexterity.

According to the invention, the glove is of the type made by double-sided knitting with several yarns, including at least one yarn having a metal part and a highly abrasion-resistant polyamide part, characterized in that the glove is knitted using three yarns, that is, a first composite yarn prepared by wrapping one or more highly abrasion-resistant or high-tenacity polyamide yarns on a composite core made by direct cabling of a stainless steel yarn and one or more highly abrasion-resistant or high-tenacity polyamide yarns, a second yarn prepared by wrapping one or more polyamide yarns on an elastane core, and a highly cut-resistant third yarn chosen among para-aramid or high-performance polyethylene (HPPE) fibers or filaments, the double-sided knitting being carried out by plating so that the first and second yarns are located on a first side of the knit while the third yarn is located on the second side of the knit.

Advantageously, the stainless steel yarn has a diameter between 10 μm and 150 μm and more advantageously between 50 μm and 70 μm. A finer yarn is difficult to handle and an excessively thick yarn makes the glove too stiff.

Advantageously, the linear density of the highly abrasion-resistant polyamide yarn cabled with the steel yarn to form the composite yarn is between 90 dtex and 700 dtex and more advantageously between 400 dtex and 600 dtex. The weight ratio between polyamide and stainless steel, on the cabled yarn (before wrapping), may vary according to the polyamid and the steel used, but is generally between 2 and 3, for example around 69.5%/30.5% or 75%/25%.

Advantageously, the linear density of the highly abrasion-resistant polyamide yarn wrapped on the first composite yarn is between 70 dtex and 600 dtex and more advantageously between 130 dtex and 200 dtex.

An excessively fine polyamide yarn is brittle and a thicker yarn reduces the dexterity of the glove.

The polyamide/stainless steel weight ratio on the final yarn (cabled+wrapped) also varies according to the polyamid and the steel used and is generally between 2 and 3, for example 76.5%/23.5% or 59.5%/40.5%.

Advantageously, the linear density of the third para-aramid yarn is between 330 dtex and 1400 dtex and more advantageously between 600 dtex and 800 dtex (or between 400 and 800 dtex when HPPE is considered). This yarn may be a yarn comprising fibres or filaments. It may also comprise a single yarn (or strand) or be the result of the joining of several yarns (or strands) by a common cabling process.

Advantageously, the polyamide used to make the cabled and wrapped yarn is a normal, high-tenacity or specific nylon-6, nylon-6,6, nylon-11 or nylon-12 polyamide. More advantageously, it can be a highly abrasion-resistant nylon-6,6 polyamide, in particular a nylon-6,6 polyamide sold under the trade mark Cordura® for a uncoated knitted glove or a high-tenacity polyamide for a coated knitted glove. The coating actually brings very good anti-abrasion properties, thus the use of Cordura® is not necessary with a coated knitted glove.

Advantageously, the glove is reinforced by para-aramid yarn, by sewing, for example oversewing, in the zone between the thumb and the forefinger.

Other features and advantages of the invention will appear from the following description of an exemplary embodiment.

BRIEF DESCRIPTION OF THE DRAWINGS

Reference is made to the appended drawings in which:

FIG. 1 is a schematic view of the main composite yarn intended for knitting a glove according to the invention, FIG. 2 is a schematic view of the direct cabling device used to make the composite core of the yarn in FIG. 1, FIG. 3 is a view of a glove according to the invention.

The glove of the invention is prepared by knitting three yarns.

DETAILED DESCRIPTION

The first yarn is a composite yarn 1 comprising a composite steel/polyamide core 2 around which one or more highly abrasion-resistant polyamide yarns 3 are wrapped, for example yarns of the type sold under the trade mark Cordura®, for example 180 dtex yarns or high-tenacity nylon-6,6 polyamide, for example 156 dtex. The Cordura® yarn is a nylon-6,6 polyamide (polyhexamethylene adipamide: $[NH—CH_2)_6—NH—CO—CH_2)_4—CO]_n$) designed to be highly abrasion-resistant.

The steel/polyamide core yarn 2 is prepared by direct cabling of a stainless steel yarn, having a diameter of 60 μm for example, and a highly abrasion-resistant polyamide yarn, for example a 560 dtex Cordura® yarn or a high-tenacity polyamide yarn, for example high-tenacity nylon-6,6 polyamide, 470 dtex. The direct cabling (known for example from document FR 2920787) is a one-step cabling process which serves to join two yarns without prior twisting, thereby keeping the filaments of each yarn parallel to one another. This method is very useful in the present invention in so far as it serves to minimize the stiffness of a cabled yarn. This has an enormous impact on the comfort, flexibility and dexterity of the knitted glove. This method is shown schematically in FIG. 2, with the steel yarn 4 taken off axially from a spool 6 of a can and the polyamide yarn 5 taken off from a spool 7 and transferred by rotating a rotating hollow spindle, in the form of a centrifugal drum having a coaxial axis with the takeoff axis of the first yarn 4. In this composite cable 2, the steel remains more or less visible and the flexibility is not substantially reduced thereby. When it is then wrapped with the yarn 3 having a substantially lower linear density than that of the direct cabling yarn 5, the flexibility of the resulting composite yarn remains sufficient to produce, after knitting, a glove that is comfortable and offers dexterity.

The first composite yarn 1 is knitted on the technical side of the glove with a second yarn prepared by wrapping one or more polyamide yarns (nylon-6, nylon-6,6, nylon-11 or nylon-12) on an elastane core which is intended to give the glove a mottled final appearance on the exterior technical side by the colouring of the polyamide (cf. FIG. 3) and to impart elasticity and comfort to the glove.

Finally, a third yarn, a para-aramid yarn (in particular a poly-p-phenylene-terephthalamide (PPDT), known by the trade name Kevlar®), is used on the side opposite the technical side, to provide additional cut resistance, and also thermal protection and comfort.

These three yarns therefore serve to knit a seamless glove in 10 gauge. The plating technique is used to prepare a double-sided knit with the first two yarns appearing on a first side constituting the front, which is the exterior technical side of the glove, and the third yarn (para-aramid) appearing on a second opposite side, constituting the back, which is the interior of the glove in contact with the skin.

FIG. 3 shows that a reinforcement 11 of para-aramid yarns prepared with a chainstitch machine serves to reinforce a zone of the glove 10 which is heavily stressed by the user, that is, the zone located between the thumb 12 and the forefinger 13. This reinforcement 11 thereby serves to further increase the service life of the glove.

Subsequently, this seamless knitted glove can optionally be coated, on the palm and/or fingers, with polymers such as polyurethane (PU), nitrile, latex, PVC, or covered with PVC drops (or points/dots). It may also be used uncoated.

Uncoated gloves fabricated as described above were tested by the two standard procedures EN388 and ISO 13997.

For EN388, it should be recalled that this test consists in measuring the number of cycles needed for a circular blade, moving back and forth and rotating about itself, to cut a sample glove. There are five levels in this standard, level 5 being the highest.

However, this test is extremely variable, unreliable, and does not represent a real risk of cutting (for example, a blow of the cutter) and gives fibres such as fibreglass excellent cut-resistant properties (the glass suffices by itself to obtain level 5), whereas glass is not a fibre that offers good protection against cutting: however, since it blunts the blade very quickly, it distorts the test.

According to standard EN388, the gloves of the invention obtained a level 4/5.

For ISO 13997, the test consists in measuring the force (in newtons) that must be applied to a sample to cut it with a blade running along 20 mm. There are five levels in this standard, level 5 offering the highest protection. To be at level 5, a force higher than 22 N must be applied in order to cut the sample while the blade runs over 20 mm.

This test therefore represents a real cut (for example a stroke of the cutter) and is much more reliable than the test of standard EN388. In the context of this standard (ISO 13997), fibreglass does not by itself give good protection against cutting. Accordingly, this standard is more suitable for measuring the real cut-resistant properties of the products tested.

According to standard ISO 13997, the gloves of the invention obtained a maximum level 5/5 (more than 37 N must be applied to cut a glove over 20 mm).

As to the abrasion tests, also defined by standard EN388, the gloves of the invention obtained a level of 3 or higher, thanks to the use of the Cordura® polyamide used, among other factors. This performance level is very high for an uncoated glove.

As to the dexterity and comfort of the gloves of the invention, they obtained the maximum level 5/5 in the dexterity test of standard EN 420. This excellent level is probably due in particular to the fact of having a stainless steel yarn joined with the Cordura® type polyamide thanks to the direct cabling technology, which offers the glove great flexibility.

The invention claimed is:

1. A glove of the type made by double-sided knitting with a plurality of yarns, comprising: three yarns, a first composite yarn prepared by wrapping one or more highly abrasion-resistant resistant or high-tenacity polyamide yarns on a composite core made by direct cabling of a stainless steel yarn and one or more highly abrasion-resistant or high-tenacity polyamide yarns, a second yarn prepared by wrapping one or more polyamide yarns on an elastane core, and a highly cut-resistant third yarn chosen among para-aramid or high-performance polyethylene (HPPE) fibers or filaments, the double-sided knitting being carried out by plating so that the first and second yarns are located on a first side of the knit while the third yarn is located on the second side of the knit.

2. The glove of claim 1, wherein the stainless steel yarn has a diameter between 10 μm and 150 μm.

3. The glove of claim 1, wherein the stainless steel yarn has a diameter between 50 μm and 70 μm.

4. The glove of claim 1, wherein the linear density of the highly abrasion-resistant or high-tenacity polyamide yarn directly cabled with the steel yarn to form the composite core is between 90 dtex and 700 dtex.

5. The glove of claim 1, wherein the linear density of the highly abrasion-resistant or high-tenacity polyamide yarn directly cabled with the steel yarn to form the composite core is between 400 dtex and 600 dtex.

6. The glove of claim 1, wherein the linear density of the highly abrasion-resistant or high-tenacity polyamide yarn wrapped on the composite core is between 70 dtex and 600 dtex.

7. The glove of claim 1, wherein the linear density of the highly abrasion-resistant or high-tenacity polyamide yarn wrapped on the composite core is between 130 dtex and 200 dtex.

8. The glove of claim 1, wherein the linear density of the third para-aramid yarn is between 330 dtex and 1400 dtex.

9. The glove of claim 1, wherein the linear density of the third para-aramid yarn is between 600 dtex and 1400 dtex.

10. The glove of claim 1, wherein the glove is reinforced with para-aramid yarn in the zone between the thumb and the forefinger.

11. The glove of claim 1, wherein at least one of the palm or the fingers of the glove is coated with polymer.

12. The glove of claim 3, wherein the linear density of the highly abrasion-resistant or high-tenacity polyamide yarn directly cabled with the steel yarn to form the composite core is between 400 dtex and 600 dtex.

13. The glove of claim 12, wherein the linear density of the highly abrasion-resistant or high-tenacity polyamide yarn wrapped on the composite core is between 130 dtex and 200 dtex.

14. The glove of claim 12, wherein the linear density of the third para-aramid yarn is between 600 dtex and 1400 dtex.

15. The glove of claim 13, wherein the linear density of the third para-aramid yarn is between 600 dtex and 1400 dtex.

16. The glove of claim 2, wherein the linear density of the highly abrasion-resistant or high-tenacity polyamide yarn directly cabled with the steel yarn to form the composite core is between 90 dtex and 700 dtex.

17. The glove of claim 16, wherein the linear density of the highly abrasion-resistant or high-tenacity polyamide yarn wrapped on the composite core is between 70 dtex and 600 dtex.

18. The glove of claim 16, wherein the linear density of the third para-aramid yarn is between 330 dtex and 1400 dtex.

19. The glove of claim 17, wherein the linear density of the third para-aramid yarn is between 330 dtex and 1400 dtex.

* * * * *